US010533798B2

(12) United States Patent
Herman et al.

(10) Patent No.: US 10,533,798 B2
(45) Date of Patent: Jan. 14, 2020

(54) APPLIANCE FOR DRYING ARTICLES

(71) Applicant: WHIRLPOOL CORPORATION, Benton Harbor, MI (US)

(72) Inventors: Mark L. Herman, Saint Joseph, MI (US); Garry L. Peterman, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/782,426

(22) Filed: Oct. 12, 2017

(65) Prior Publication Data

US 2018/0031316 A1 Feb. 1, 2018

Related U.S. Application Data

(63) Continuation of application No. 13/966,577, filed on Aug. 14, 2013.

(51) Int. Cl.

| | |
|---|---|
| ***F26B 3/34*** | (2006.01) |
| ***H05B 6/54*** | (2006.01) |
| ***H05B 6/62*** | (2006.01) |
| ***D06F 58/20*** | (2006.01) |
| ***D06F 58/26*** | (2006.01) |

(52) U.S. Cl.

CPC ..... *F26B 3/343* (2013.01); *D06F 58/20* (2013.01); *D06F 58/266* (2013.01); *H05B 6/54* (2013.01); *H05B 6/62* (2013.01)

(58) Field of Classification Search

CPC . F26B 3/343; F26B 7/002; F26B 3/34; H05B 6/54; H05B 6/62; D06F 58/266; D06F 58/20; D06F 58/10

USPC ..... 34/255, 250; 219/773, 780

See application file for complete search history.

(56) References Cited

U.S. PATENT DOCUMENTS

| | | | |
|---|---|---|---|
| 1,503,224 | A | 7/1924 | Blaine |
| 1,871,269 | A | 8/1932 | Hobrock |
| 2,112,418 | A | 3/1938 | Hart, Jr. et al. |
| 2,212,522 | A | 8/1940 | Hart, Jr. et al. |
| 2,228,136 | A | 1/1941 | Hart, Jr. |
| 2,231,457 | A | 2/1941 | Stephen |

(Continued)

FOREIGN PATENT DOCUMENTS

| | | | |
|---|---|---|---|
| EP | 0269358 | A2 | 6/1988 |
| EP | 0269358 | A3 | 8/1989 |

(Continued)

OTHER PUBLICATIONS

European Search Report for Corresponding EP14178568.3, dated Feb. 16, 2015.

(Continued)

*Primary Examiner* — Kenneth Rinehart
*Assistant Examiner* — Bao D Nguyen
(74) *Attorney, Agent, or Firm* — McGarry Bair PC

(57) ABSTRACT

An RF laundry dryer includes, amongst other things, an RF generator, an RF applicator having a perforated body supporting anode and cathode elements, a fan arranged relative to the perforated body to flow or draw air through the perforated body and an electromagnetic shield protecting the fan from the e-field. Both anode and cathode elements are operably coupled to the RF generator to generate an e-field between the anode and cathode upon the energizing of the RF generator.

20 Claims, 5 Drawing Sheets

(56) References Cited

U.S. PATENT DOCUMENTS

| | | | | |
|---|---|---|---|---|
| 2,276,996 | A | 3/1942 | Milinowski | |
| 2,449,317 | A | 9/1948 | Pitman | |
| 2,511,839 | A * | 6/1950 | Frye | D06F 58/26 219/774 |
| 2,542,589 | A | 2/1951 | Stanton et al. | |
| 2,582,806 | A | 1/1952 | Nes et al. | |
| 2,642,000 | A | 6/1953 | Wieking | |
| 2,656,839 | A | 10/1953 | Howard | |
| 2,740,756 | A | 4/1956 | Thomas | |
| 2,773,162 | A | 12/1956 | Christensen | |
| 3,161,480 | A | 12/1964 | Birch-Iensen et al. | |
| 3,184,637 | A | 5/1965 | Skinner | |
| 3,316,380 | A | 4/1967 | Pansing | |
| 3,355,812 | A | 12/1967 | Bennett | |
| 3,364,294 | A | 1/1968 | Garibian et al. | |
| 3,426,439 | A | 2/1969 | Ryman et al. | |
| 3,439,431 | A | 4/1969 | Heidtmann | |
| 3,537,185 | A | 11/1970 | Ingram | |
| 3,543,408 | A | 12/1970 | Candor et al. | |
| 3,601,571 | A | 8/1971 | Curcio | |
| 3,652,816 | A | 3/1972 | Preston | |
| 3,701,875 | A | 10/1972 | Witsey et al. | |
| 3,754,336 | A | 8/1973 | Feild | |
| 3,878,619 | A * | 4/1975 | Hodgett | D06C 7/00 34/247 |
| 3,969,225 | A | 7/1976 | Horowitz | |
| 4,014,732 | A | 3/1977 | Beckert et al. | |
| 4,028,518 | A | 6/1977 | Bourdouris et al. | |
| 4,119,826 | A | 10/1978 | Chambley et al. | |
| 4,197,851 | A | 4/1980 | Fellus | |
| 4,296,298 | A | 10/1981 | MacMaster et al. | |
| 4,296,299 | A | 10/1981 | Stottmann et al. | |
| 4,365,622 | A | 12/1982 | Harrison | |
| 4,409,541 | A | 10/1983 | Richards | |
| 4,523,387 | A | 6/1985 | Mahan | |
| 4,529,855 | A | 7/1985 | Fleck | |
| 4,638,571 | A | 1/1987 | Cook | |
| 5,152,075 | A * | 10/1992 | Bonar | D06F 58/02 204/213 |
| 5,495,250 | A | 2/1996 | Ghaem et al. | |
| 5,838,111 | A | 11/1998 | Hayashi et al. | |
| 5,983,520 | A | 11/1999 | Kim et al. | |
| 6,124,584 | A | 9/2000 | Blaker et al. | |
| 6,189,231 | B1 * | 2/2001 | Lancer | A47K 10/48 34/90 |
| 6,531,880 | B1 | 3/2003 | Schneider et al. | |
| 6,812,445 | B2 | 11/2004 | Gorbold | |
| 7,526,879 | B2 | 5/2009 | Bae et al. | |
| 7,619,403 | B2 | 11/2009 | Kashida | |
| 7,676,953 | B2 | 3/2010 | Magill | |
| 7,883,609 | B2 | 2/2011 | Petrenko et al. | |
| 8,499,472 | B2 | 8/2013 | Bari et al. | |
| 8,826,561 | B2 | 9/2014 | Wisherd et al. | |
| 8,839,527 | B2 | 9/2014 | Ben-Shmuel et al. | |
| 8,943,705 | B2 | 2/2015 | Wisherd et al. | |
| 9,127,400 | B2 | 9/2015 | Herman et al. | |
| 9,173,253 | B2 | 10/2015 | Wohl et al. | |
| 9,194,625 | B2 | 11/2015 | Herman et al. | |
| 9,200,402 | B2 | 12/2015 | Wisherd et al. | |
| 9,410,282 | B2 | 8/2016 | Herman et al. | |
| 9,447,537 | B2 | 9/2016 | Wisherd et al. | |
| 9,540,759 | B2 | 1/2017 | Herman et al. | |
| 9,605,899 | B2 | 3/2017 | Herman | |
| 9,784,499 | B2 | 10/2017 | Herman | |
| 2002/0047009 | A1 | 4/2002 | Flugstad et al. | |
| 2003/0199251 | A1 | 10/2003 | Gorbold | |
| 2004/0149734 | A1 | 8/2004 | Petrenko et al. | |
| 2005/0120715 | A1 | 6/2005 | Labrador | |
| 2005/0286914 | A1 * | 12/2005 | Nagahama | G03G 21/1882 399/12 |
| 2006/0097726 | A1 | 5/2006 | Frederick et al. | |
| 2006/0289526 | A1 | 12/2006 | Takizaki et al. | |
| 2007/0045307 | A1 | 3/2007 | Tsui et al. | |
| 2008/0134792 | A1 | 6/2008 | Lee et al. | |
| 2009/0172965 | A1 * | 7/2009 | Campagnolo | D06F 58/16 34/72 |
| 2009/0195255 | A1 | 8/2009 | Kalokitis et al. | |
| 2010/0115785 | A1 | 5/2010 | Ben-Shmuel et al. | |
| 2011/0245900 | A1 | 10/2011 | Turner et al. | |
| 2011/0308101 | A1 | 12/2011 | Wisherd et al. | |
| 2012/0164022 | A1 | 6/2012 | Muginstein et al. | |
| 2012/0247800 | A1 | 10/2012 | Shah et al. | |
| 2012/0291304 | A1 | 11/2012 | Wisherd et al. | |
| 2013/0119055 | A1 | 5/2013 | Wohl et al. | |
| 2013/0201068 | A1 | 8/2013 | Alexopoulos et al. | |
| 2013/0207674 | A1 | 8/2013 | Hahl et al. | |
| 2013/0271811 | A1 | 10/2013 | Lam et al. | |
| 2013/0316051 | A1 | 11/2013 | Van Der Voort et al. | |
| 2014/0325865 | A1 | 11/2014 | Wisherd et al. | |
| 2015/0020403 | A1 | 1/2015 | Herman et al. | |
| 2015/0089829 | A1 | 4/2015 | Herman et al. | |
| 2015/0101207 | A1 | 4/2015 | Herman et al. | |
| 2015/0102801 | A1 | 4/2015 | Herman et al. | |
| 2015/0159949 | A1 | 6/2015 | Herman et al. | |
| 2015/0187971 | A1 | 7/2015 | Sweeney et al. | |
| 2018/0266041 | A1 | 9/2018 | Herman et al. | |
| 2019/0128605 | A1 | 5/2019 | Herman et al. | |

FOREIGN PATENT DOCUMENTS

| | | | |
|---|---|---|---|
| EP | 1753265 | A1 | 2/2007 |
| EP | 2827087 | A1 | 1/2015 |
| EP | 2840340 | A2 | 2/2015 |
| EP | 3073008 | A1 | 9/2016 |
| GB | 601855 | A | 5/1948 |
| GB | 1255292 | A | 12/1971 |
| GB | 2019543 | A | 10/1979 |
| JP | 4307095 | A | 10/1992 |
| WO | 2009106906 | A1 | 9/2009 |
| WO | 2012001523 | A2 | 1/2012 |

OTHER PUBLICATIONS

European Search Report for Corresponding EP14175081.0, dated Dec. 4, 2014.

"British Help American Wounded: Rehabilitation and Treatment, UK, 1944", Ministry of Information Second World War Official.

European Search Report for Corresponding EP14179021.2, dated Feb. 3, 2015.

European Search Report for Counterpart EP16155782.2, dated Jul. 28, 2016.

* cited by examiner

APPLIANCE FOR DRYING ARTICLES

CROSS-REFERENCE TO RELATED APPLICATION(S)

This application claims priority to and is a continuation of U.S. patent application Ser. No. 13/966,577, filed Aug. 14, 2013, which is incorporated herein by reference in its entirety.

BACKGROUND OF THE INVENTION

Dielectric heating is the process in which a high-frequency alternating electric field heats a dielectric material, such as water molecules. At higher frequencies, this heating is caused by molecular dipole rotation within the dielectric material, while at lower frequencies in conductive fluids, other mechanisms such as ion-drag are more important in generating thermal energy.

Microwave frequencies are typically applied for cooking food items and are considered undesirable for drying laundry articles because of the possible temporary runaway thermal effects random application of the waves in a traditional microwave. Radio frequencies and their corresponding controlled and contained e-field are typically used for drying of textiles.

When applying an RF electronic field (e-field) to a wet article, such as a clothing material, the e-field may cause the water molecules within the e-field to dielectrically heat, generating thermal energy that effects the rapid drying of the articles.

BRIEF DESCRIPTION OF THE INVENTION

One aspect of the invention is directed to a radio frequency (RF) laundry dryer. The RF laundry dryer includes an RF generator, an RF applicator having a perforated body supporting anode and cathode elements, with both elements operably coupled to the RF generator to generate an e-field between the anode and cathode upon the energizing of the RF generator, a fan arranged relative to the perforated body to flow or draw air through the perforated body and an electromagnetic shield protecting the fan from the e-field.

DESCRIPTION OF EMBODIMENTS OF THE INVENTION

While this description may be primarily directed toward a laundry drying machine, the invention may be applicable in any environment using a radio frequency (RF) signal application to dehydrate any wet article.

Figure 1:
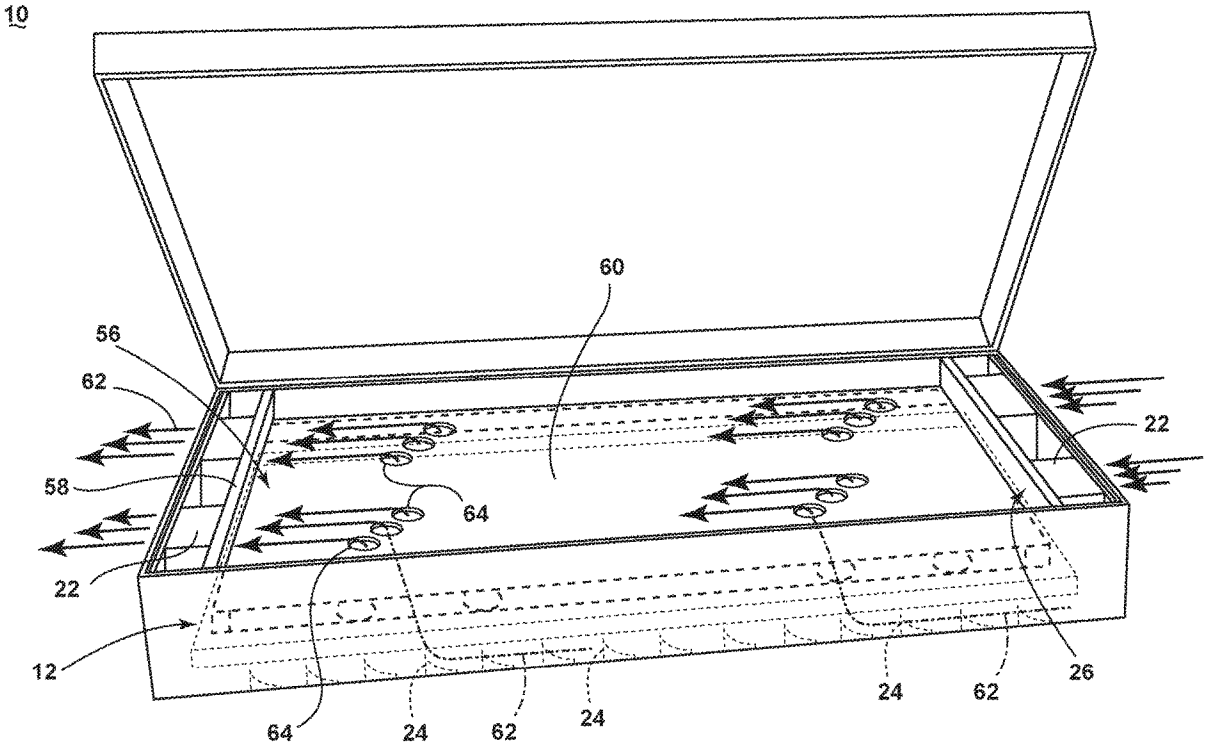
FIG. 1 is a schematic perspective view of the RF laundry dryer in accordance with an embodiment of the invention.
Figure 2:
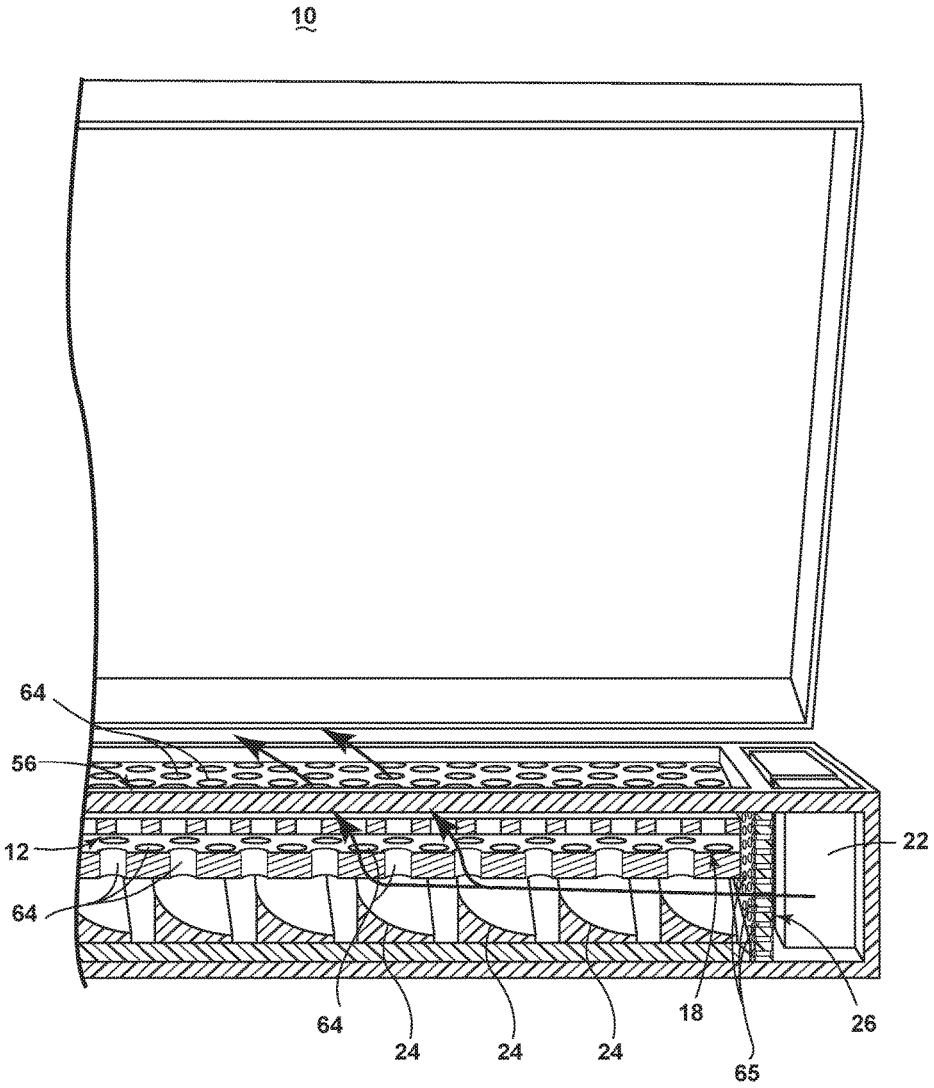
FIG. 2 is a partial sectional view of FIG. 1 showing air flow over the baffles of the RF laundry dryer in accordance with the embodiment of the invention shown in FIG. 1.
Figure 3:
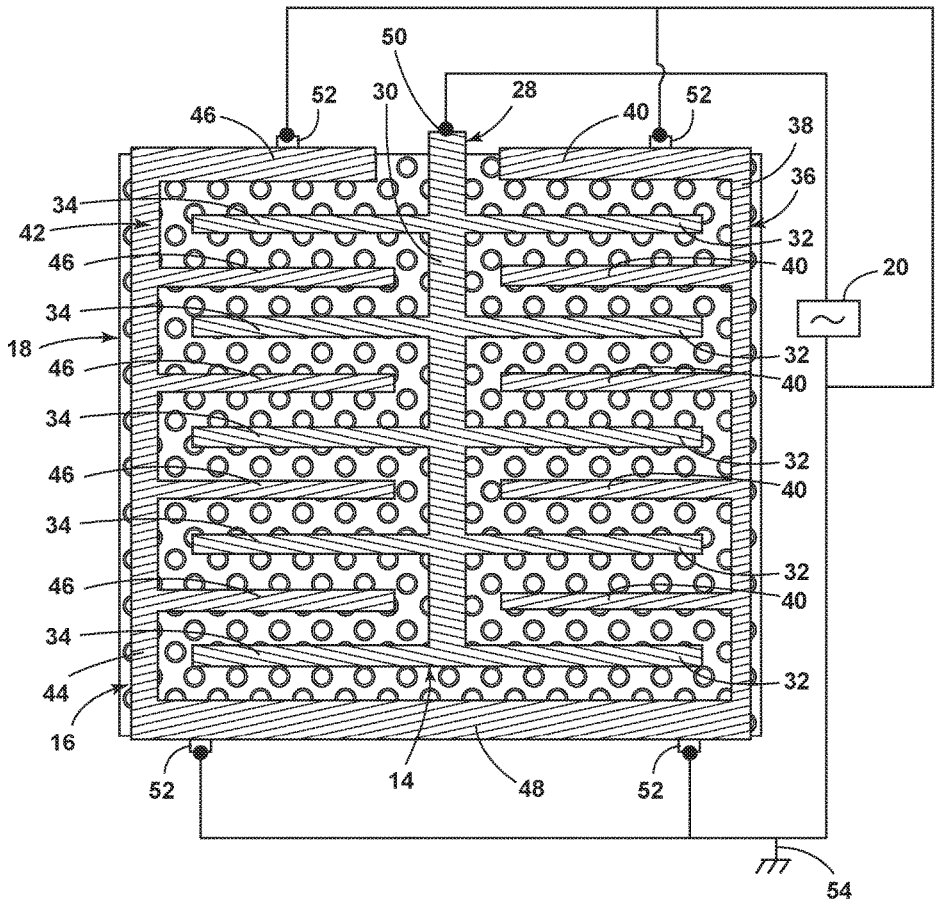
FIG. 3 is a schematic view of the anode and cathode elements of the RF applicator in accordance with the embodiment of the invention shown in FIG. 1.

FIG. 1 is a schematic illustration of an RF laundry drying appliance 10 according to an embodiment of the invention for dehydrating one or more articles of laundry. As illustrated in FIGS. 1-3, the RF laundry drying appliance 10 includes an RF applicator 12 that includes conductive elements, such as an anode element 14 and an opposing cathode element 16; each element supported by a perforated body 18. The laundry drying appliance 10 additionally includes an RF generator 20 and one or more fans 22 arranged relative to the perforated body 18 to flow air through the perforated body 18. A perforated electromagnetic shield 26 may be placed between the fans 22 and the RF applicator 12. One or more baffles 24 may be arranged between the one or more fans 22 and the perforated body 18 to direct air from the fans 22 through the perforated body 18.

As more clearly seen in FIG. 3, the anode element 14 may further include at least one anode contact point 50 and a tree element 28 having a base 30 from which extends a first plurality of digits 32 and a second plurality of digits 34. The first and second plurality of digits 32, 34 extend from opposite sides of the base 30 perpendicular to the length of the base 30. In a preferred embodiment of the anode element 14, each member of the first plurality of digits 32 has a one-to-one corresponding member of the second plurality of digits 34 that is coupled to the base 30 at the same location as the corresponding member of the second plurality of digits 34.

The cathode element 16 may further include at least one contact point 52, a first comb element 36 having a first base 38 from which extend a first plurality of digits 40 and a second comb element 42 having a second base 44 from which extend a second plurality of digits 46. The anode and cathode elements 14, 16 are fixedly mounted to the supporting perforated body 18 in such a way as to interdigitally arrange the first plurality of digits 32 of the tree element 28 of the anode 14 and the first plurality of digits 40 of the first comb element 36 of the cathode 16. Additionally, the anode and cathode elements 14, 16 are fixedly mounted to the supporting perforated body 18 in such a way as to interdigitally arrange the second plurality of digits 34 of the tree element 28 of the anode 14 and the second plurality of digits 46 of the second comb element 42 of the cathode 16.

All of the elements of the anode and cathode elements 14, 16 are preferably arranged in a coplanar configuration. The first base element 38 of the cathode element 16 and the second base element 44 of the cathode element 16 will be in physical connection by way of a third interconnecting base element 48 that effectively wraps the first and second comb elements 36, 42 of the cathode element 16 around the anode element 14 in a given plane to form a single point of access for external connection of the anode's base element 30 to a contact point 50. Other arrangements of the digits, base elements and contact points of the anode may be implemented. For example, the digits of either the first plurality or second plurality of digits 32, 34 may not be perpendicular to the base element 30. The digits of either the first plurality and the second plurality of digits 32, 34 may not intersect the base element 30 at the same angle or location. The digits may further include geometries more complicated than the simple linear structures shown in FIG. 3. Many alternative configurations may be implemented to form the plurality of digits, the base elements and the interconnections between the base elements and the digits of the anode and cathode elements.

The anode and cathode elements 14, 16 may be fixedly mounted to the supporting perforated body 18 by, for example, adhesion, fastener connections, or laminated layers. Alternative mounting techniques may be employed.

The RF applicator 12 may be configured to generate a field of electromagnetic radiation (e-field) within the radio frequency spectrum between the anode 14 and cathode 16 elements. The anode element 14 of the RF applicator 12 may be electrically coupled to an RF generator 20 by a contact point 50 on the anode element 14. The cathode element 16 of the RF applicator may be electrically coupled to the RF generator 20 by one or more additional contact points 52 of the cathode element 16. The cathode contact points 52 and their connection to the RF generator 20 are additionally connected to an electrical ground 54. In this way, the RF generator 20 may apply an RF signal of a desired power level and frequency to energize the RF applicator 12. One such example of an RF signal generated by the RF applicator 12 may be 13.56 MHz. The radio frequency 13.56 MHz is one frequency in the band of frequencies between 13.553 MHz and 13.567 MHz. The band of frequencies between 13.553 MHz and 13.567 MHz is known as the 13.56 MHz band and is one of several bands that make up the industrial, scientific and medical (ISM) radio bands. The generation of another RF signal, or varying RF signals, particularly in the ISM radio bands, is envisioned.

Microwave frequencies are typically applied for cooking food items. However, their high frequency and resulting greater dielectric heating effect make microwave frequencies undesirable for drying laundry articles. Radio frequencies and their corresponding lower dielectric heating effect are typically used for drying of laundry. In contrast with a conventional microwave heating appliance, where microwaves generated by a magnetron are directed into a resonant cavity by a waveguide, the RF applicator 12 induces a controlled electromagnetic field between the anode and cathode elements 14, 16. Stray-field or through-field electromagnetic heating; that is, dielectric heating by placing wet articles near or between energized applicator elements, provides a relatively deterministic application of power as opposed to conventional microwave heating technologies where the microwave energy is randomly distributed (by way of a stirrer and/or rotation of the load). Consequently, conventional microwave technologies may result in thermal runaway effects that are not easily mitigated when applied to certain loads (such as metal zippers etc.). It is understood that the differences between microwave ovens and RF dryers arise from the differences between the implementation structures of applicator vs. magnetron/waveguide, which renders much of the microwave solutions inapplicable for RF dryers. It may be instructive to consider how the application of electromagnetic energy in RF dryers differs than the application of electromagnetic energy in conventional microwave technology with an analogy. For example, if electromagnetic energy is analogous to water, then a conventional microwave acts as a sprinkler randomly radiating in an omni-directional fashion whereas the RF dryer is akin to a wave pool.

Figure 4:
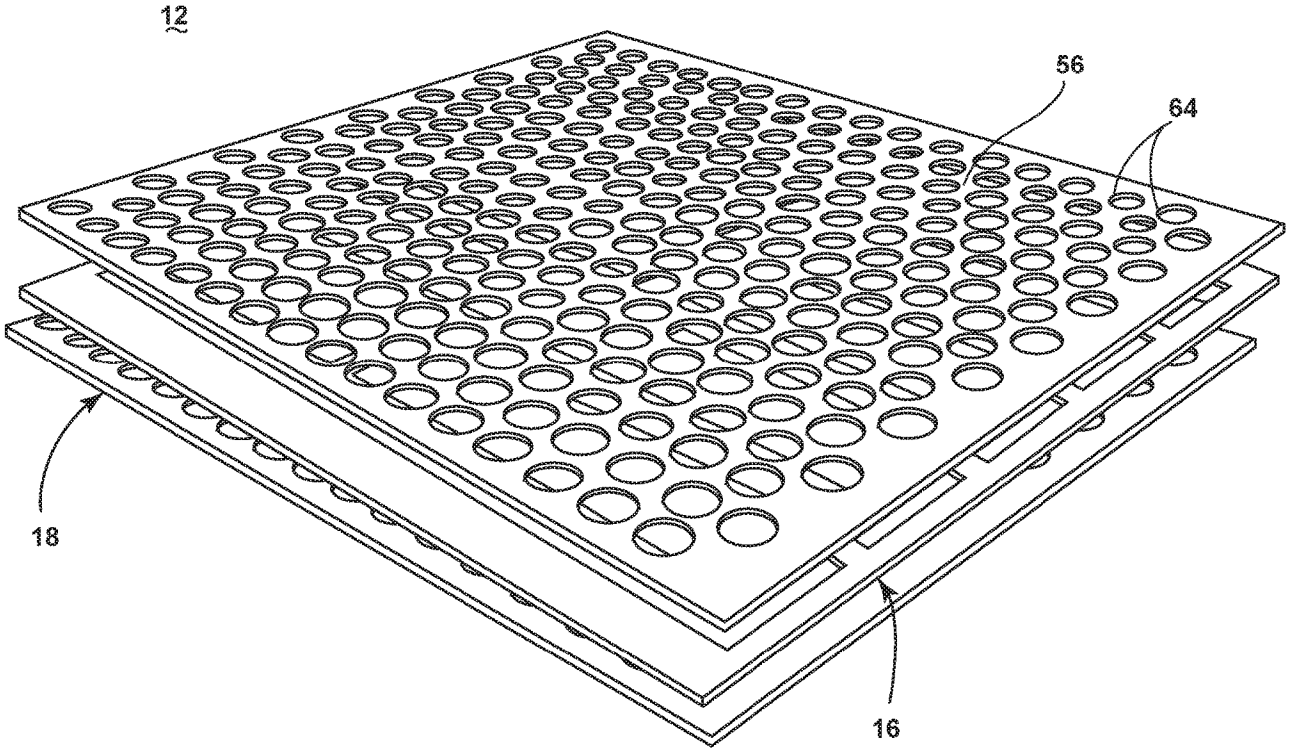
FIG. 4 is a schematic perspective view of the perforated body supporting the anode and cathode elements of the RF applicator in accordance with the embodiment of the invention shown in FIG. 1.

Each of the conductive anode and cathode elements 14, 16 remain at least partially spaced from each other by a separating gap, or by non-conductive segments. By fixedly mounting the anode and cathode elements 14, 16 to the supporting perforated body 18 as described above, the anode and cathode elements 14, 16 may remain appropriately spaced. Referring now to FIG. 4, another perforated body 56 may be placed above the anode and cathode elements 14, 16. In this configuration, the anode and cathode elements 14, 16 may be sandwiched between the perforated bodies 18, 56. The supporting perforated body 18, 56 may be made of any suitable low loss, fire retardant materials, or at least one layer of insulating materials that isolates the conductive anode and cathode elements 14, 16.

The supporting perforated bodies 18, 56 may also provide a rigid structure for the RF laundry drying appliance 10 shown in FIG. 1, or may be further supported by secondary structural elements, such as a frame or truss system. Alternative support structures other than perforated bodies 18, 56 may be implemented to support the anode and cathode elements. The presence or geometrical shape and configuration of foramina in the supporting structure may be instantiated in many ways depending upon the implementation.

Returning to FIG. 1 in accordance with an embodiment of the invention, the perforated body 56 including the arrangement of perforations 64 as best seen in FIG. 4 may further include non-conductive walls 58 wherein the walls 58 may be positioned above or below the interdigitally arranged pluralities of digits 32, 34, 40, 46 and extending above and/or below the perforated body 56. The bed further includes a flat upper surface 60 for receiving wet textiles and forms a drying surface located on which textiles may be supported.

The aforementioned structure of the RF laundry drying appliance 10 operates by creating a capacitive coupling between the pluralities of digits 32, 40 and 34, 46 of the anode element 14 and the cathode element 16, at least partially spaced from each other. During drying operations, wet textiles to be dried may be placed on the upper surface 60 of the bed. During, for instance, a predetermined cycle of operation, the RF applicator 12 may be continuously or intermittently energized to generate an e-field between the capacitive coupling which interacts with liquid in the textile. The liquid residing within the e-field will be dielectrically heated to effect a drying of the textile.

Figure 5:
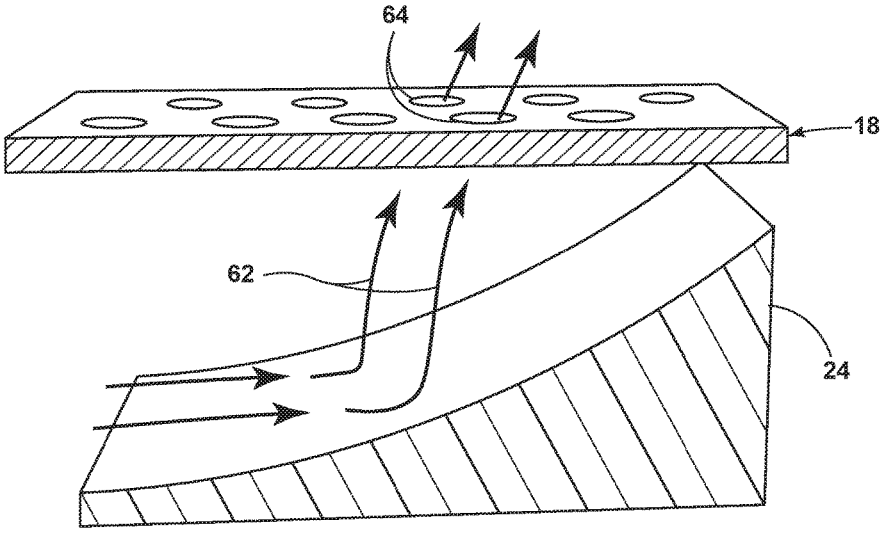
FIG. 5 is a schematic perspective view of a baffle of the RF laundry dryer in FIG. 1 directing air from a fan through the perforated body of the RF applicator according to the embodiment of the invention shown in FIG. 1.

During the drying process, water in the wet clothing may become heated to the point of evaporation. As seen in FIGS. 1 and 5, to aid in the drying process, air flow 62 from one or more fans 22 may be directed through the perforated bodies 18, 56 and through the drying textiles placed on the upper surface 60 of the bed. The perforations 64 in the perforated bodies 18, 56 direct the air flow 62 through the entire surface of the textile and more uniformly dry the textile. The perforations 64 in the perforated bodies 18, 56 may be aligned vertically to maximize the airflow. Additionally, as best seen in FIG. 2 and FIG. 5, to uniformly direct the air flow 62 through the entire surface of the perforated bodies 18, one or more baffles 24 are located between the one or more fans 22 to direct the air from the fans 22 from a substantially horizontal to a substantially vertical flow through the perforations of the perforated body 18. Fans 22 may be placed on either side of the bed so that air may be pushed and/or pulled through the applicator.

Alternatively, the RF dryer may be configured in a substantially vertical orientation. The relative configuration of the fans, the baffles and the perforated body may enable air flow to be directed along a vector substantially orthogonal to the drying surface and through the perforations of the perforated body 18. In this way, it is understood that the air flow can be directed in any particular direction be it up or down or left or right without loss of effectiveness as long as the air flow is uniformly directed through the perforated body.

The perforated body 18 and the anode, cathode and drying surface of the RF laundry drying appliance 10 may be placed between the one or more fans 22. To act as an electromagnetic shield 26, a perforated body may contain at least one layer of a conductive material to protect the one or more fans 22 from the e-field generated by the RF applicator 12. The dimensions of the perforations 64 provided in the perforated body 18 are selected to be of a size to maximize air flow and prevent textile material from drooping into the perforations.

The e-field across the anode and cathode elements 14, 16 may not pass through the perforated body of the electromagnetic shield 26 and electrically interfere with the operation of the fans 22. The dimensions of the perforations 65 may be selected according to one of many functions related to wavelength. For example, selecting the dimension of the perforations 65 to be approximately $1/20^{th}$ or smaller of the wavelength of the e-field results in perforations smaller than 1.1 meters for an RF applicator operating at 13.6 MHz to provide an effective electromagnetic shield for the one or more fans 22. A second example arises when considering an RF applicator operating at a frequency in the 2.4 GHz ISM band. In this example, the largest dimension of the perforations may not exceed 0.63 cm to be approximately $1/20^{th}$ the wavelength of the RF applicator. However, due to magnetics, near-field effects and harmonics, the dimensions of the perforations are much smaller and are generally selected to be as small as possible without limiting air flow. Other methods may be used and may primarily be driven by the standards required relating to the mitigation or prevention of electromagnetic leakage.

In this way, textiles may be dried in the RF laundry dryer by flowing air from at least one fan 22 through the perforations in the perforated body 18 onto textiles supported by the RF applicator 12 and electromagnetically shielding the at least one fan 22 during the flowing of the air from the bottom to the top or the top to the bottom of the RF applicator 12. The vertical flowing of the air through the RF applicator 12 via the perforations of the perforated body 18 is directed, in part, by the baffles 24 placed on top or underneath the RF applicator 12. By forming a composite of the perforated bodies 18, 56 and the anode and cathode elements 14, 16 in the RF applicator 12, the structure effectively increases drying efficiency by directing air flow 62 through the RF applicator 12 and provides electromagnetic shielding of electronic components such as fans 22.

Many other possible configurations in addition to that shown in the above figures are contemplated by the present embodiment. For example, one embodiment of the invention contemplates different geometric shapes for the laundry drying appliance 10, such as a substantially longer, rectangular appliance 10 where the anode and cathode elements 14, 16 are elongated along the length of the appliance 10, or the longer appliance 10 includes a plurality of anode and cathode element 14, 16 sets.

In such a configuration, the upper surface 60 of the bed may be smooth and slightly sloped to allow for the movement of wet laundry across the laundry drying appliance 10, wherein the one or more anode and cathode element 14, 16 sets may be energized individually or in combination by one or more RF applicators 12 to dry the laundry as it traverses the appliance 10.

The aspects disclosed herein provide a laundry treating appliance using RF applicator to dielectrically heat liquid in wet articles to effect a drying of the articles. One advantage that may be realized in the above aspects may be that the above described aspects are able to dry articles of clothing during rotational or stationary activity, allowing the most efficient e-field to be applied to the clothing for particular cycles or clothing characteristics. A further advantage of the above aspects may be that the above aspects allow for selective energizing of the RF applicator according to such additional design considerations as efficiency or power consumption during operation.

Additionally, the design of the anode and cathode may be controlled to allow for individual energizing of particular RF applicators in a single or multi-applicator embodiment. The effect of individual energization of particular RF applicators results in avoiding anode/cathode pairs that would result in no additional material drying (if energized), reducing the unwanted impedance of additional anode/cathode pairs and electromagnetic fields, and an overall reduction to energy costs of a drying cycle of operation due to increased efficiencies.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A radio frequency (RF) laundry dryer comprising:

a first perforated planar drying body for receiving and supporting wet textiles;

an RF generator;

an RF applicator located beneath the planar drying body and comprising a second perforated body supporting interdigitally arranged planar anode element and planar cathode element operably coupled to the RF generator, wherein the anode and cathode elements are coplanar and the arrangement is configured to generate an e-field between the anode and cathode elements that extends above the first perforated planar drying body;

at least one fan arranged relative to the second perforated body to flow air below the second perforated body;

at least two baffles sequentially arranged in the direction of the air flow and similarly oriented to direct the air flow through the second perforated body to below the first perforated planar drying body; and an electromagnetic shield having a conductive layer and located between the fan and the cathode and anode elements to electromagnetically protect the at least one fan from the e-field.

2. The RF laundry dryer of claim 1 wherein the electromagnetic shield includes the second perforated body, wherein a dimension of the second perforated body perforations is selected to at least one of mitigate or prevent e-field leakage toward the fan.

3. The RF laundry dryer of claim 1 further comprising at least one baffle located between the at least one fan and the second perforated body and oriented to direct the air from the at least one fan through the second perforated body.

4. The RF laundry dryer of claim 1 further comprising at least one baffle located between the at least one fan and the first perforated planar drying body and oriented to direct the air from the at least one fan through the first perforated planar drying body.

5. The RF laundry dryer of claim 1 wherein the RF generator is configured to generate an e-field at a frequency between 13.553 MHz and 13.567 MHz.

6. The RF laundry dryer of claim 1 wherein the anode and cathode elements are sandwiched between the first perforated planar drying body and the second perforated body.

7. The RF laundry dryer of claim 1 wherein the first perforated planar drying body and the second perforated body comprise perforations of a size to maximize air flow through the first perforated planar drying body and the second perforated body.

8. The RF laundry dryer of claim 1 wherein the first perforated planar drying body includes perforations of a size to prevent textile material placed on the first perforated planar drying body from drooping into the RF applicator.

9. The RF laundry dryer of claim 1 wherein the first perforated planar drying body is spaced from the second perforated body.

10. The RF laundry dryer of claim 1 wherein the perforations of the first perforated planar drying body and the second perforated body are aligned.

11. The RF laundry dryer of claim 10 further including at least one baffle located between the at least one fan and the second perforated body and oriented to direct the air from the fan through the aligned perforations of the first perforated planar drying body and the second perforated body.

12. The RF laundry dryer of claim 1 wherein the anode element includes a tree element having a tree base from which extend a first plurality of digits and wherein the cathode element includes a comb element having a comb base from which extend a second plurality of digits, and wherein the first plurality of digits and the second plurality of digits are interdigitally arranged.

13. The RF laundry dryer of claim 12 wherein the anode element includes a third plurality of digits extending from the side of the tree base opposite to the first plurality of digits.

14. The RF laundry dryer of claim 13 wherein the cathode element includes a fourth plurality of digits, and wherein the third plurality of digits and the fourth plurality of digits are interdigitally arranged.

15. A method of drying laundry, comprising:

operating a fan to flow air beneath a first perforated body of a radio frequency (RF) applicator; and redirecting the air, by way of at least two baffles sequentially arranged in the direction of the air flow and similarly oriented, through the first perforated body to below a second perforated planar drying body while an e-field generated from a planar anode element and a planar cathode element on the first perforated body extends above the second perforated planar drying body and electromagnetically shielding the fan from the e-field, wherein the planar anode element and the planar cathode element are coplanar.

16. The method of claim 15 wherein the redirecting comprises redirecting the air through the first perforated body by way of at least one baffle.

17. The method of claim 16 further including disposing at least one of the first perforated body perforations or the at least one baffle relative to the other of the first perforated body perforations or the at least one baffle such that the redirecting the air is maximized.

18. The method of claim 15 wherein the redirecting the air includes redirecting the air through a wet textile.

19. The method of claim 15 wherein shielding the fan from the e-field includes shielding by way of an electromagnetic shield disposed between the fan and the RF applicator.

20. The method of claim 15 wherein the redirecting the air includes redirecting the air from a vector parallel to the second perforated planar drying body to a vector orthogonal to the second perforated planar drying body.

* * * * *